US011679915B2

(12) United States Patent
Fung et al.

(10) Patent No.: US 11,679,915 B2
(45) Date of Patent: Jun. 20, 2023

(54) CONTAINER ASSEMBLY WITH A MAGNETIC LOCKING MECHANISM

(71) Applicants: Kirsten Fung, Fairfax, VA (US); Alexandra Huszcza, Manassas, VA (US); Marliana Marraccini, Hamilton, VA (US); Adeline Hayes Mock, Annapolis, MD (US)

(72) Inventors: Kirsten Fung, Fairfax, VA (US); Alexandra Huszcza, Manassas, VA (US); Marliana Marraccini, Hamilton, VA (US); Adeline Hayes Mock, Annapolis, MD (US)

( * ) Notice: Subject to any disclaimer, the term of this patent is extended or adjusted under 35 U.S.C. 154(b) by 0 days.

(21) Appl. No.: 17/404,079

(22) Filed: Aug. 17, 2021

(65) Prior Publication Data

US 2022/0055807 A1 Feb. 24, 2022

Related U.S. Application Data

(60) Provisional application No. 63/068,707, filed on Aug. 21, 2020.

(51) Int. Cl.
*B65D 50/06* (2006.01)
*E05C 19/16* (2006.01)

(52) U.S. Cl.
CPC ..... *B65D 50/067* (2013.01); *E05C 19/16* (2013.01); *B65D 2215/02* (2013.01); *B65D 2215/04* (2013.01); *B65D 2313/04* (2013.01)

(58) Field of Classification Search
CPC ... B65D 2313/04; E05C 19/16; E05C 19/163; E05B 47/0038; E05B 47/004; Y10T 292/11
USPC ..... 215/220; 220/230
See application file for complete search history.

(56) References Cited

U.S. PATENT DOCUMENTS

| | | | | |
|---|---|---|---|---|
| 4,489,842 | A | 12/1984 | Bobrove | |
| 7,004,340 | B2 | 2/2006 | Belden, Jr. | |
| 7,259,674 | B2 * | 8/2007 | Marsilio | G08B 13/2434 215/279 |
| 2005/0205511 | A1 * | 9/2005 | Belden | B65D 55/14 215/206 |
| 2006/0175842 | A1 * | 8/2006 | Saitoh | E05C 19/163 292/251.5 |

FOREIGN PATENT DOCUMENTS

WO 9718371 A1 5/1997

* cited by examiner

*Primary Examiner* — Rafael A Ortiz
*Assistant Examiner* — Sanjidul Islam
(74) *Attorney, Agent, or Firm* — Brooks Kushman P.C.

(57) ABSTRACT

A container assembly is provided with a container and a lid, with the lid cooperating with the container to enclose the interior of the container. A magnetic member is supported by the lid or the container for transverse movement between a first position and a second position. When the lid is cooperatively associated with the container, the magnetic member is in the first position and inhibits movement of the lid along a longitudinal axis of the container to lock the container. With the magnetic member in the second position, the lid is moveable along the longitudinal axis to open the container.

16 Claims, 9 Drawing Sheets

(open)

(closed)

CONTAINER ASSEMBLY WITH A MAGNETIC LOCKING MECHANISM

CROSS-REFERENCE TO RELATED APPLICATIONS

This application claims the benefit of U.S. provisional application Ser. No. 63/068,707 filed Aug. 21, 2020, the disclosure of which is hereby incorporated in its entirety by reference herein.

TECHNICAL FIELD

Various embodiments relate to a locking mechanism for a lid of a container.

BACKGROUND

Containers and lids may have locks or other features to retain the lid onto the container and secure the contents of the container, such as for child-resistant packaging. For example, a medicine bottle or container typically has a lid or cap with a child-resistant lock, e.g. a safety cap. While the child-resistant lock is difficult for children to open, it also makes the bottle difficult for certain adults, such as seniors and those with mobility issues such as arthritis to open as well. Adults may need access to the medicine in the bottles; however, due to reduced strength, reduced dexterity, or other health concerns, it may be difficult or impossible for them to open the bottle without assistance from another person. Conventionally, medicine bottles require some type of pushing, pulling, turning, or squeezing motion and associated force to unlock the cap and open the bottle.

SUMMARY

In an embodiment, a container assembly has a container having a first side wall extending outwardly from a base along a longitudinal axis to a distal end region, with the first side wall defining an interior of the container, and the distal end region defining an aperture to provide access to the interior. The distal end region defines a recess. A lid has a second side wall extending outwardly from an end wall. A magnetic member is supported by the lid for transverse movement between a first position and a second position. The first side wall of the container is sized to be received by the second side wall of the lid to enclose the interior of the container. When the lid is cooperatively associated with the container, the magnetic member is received by the recess in the first position to inhibit movement of the lid along the longitudinal axis and lock the container. With the magnetic member in the second position, the magnetic member is spaced apart from the recess such that the lid is moveable along the longitudinal axis to open the container.

In another embodiment, a container assembly has a container having a first side wall extending from a base along a longitudinal axis to a distal end region, with the first side wall defining an interior of the container, and the distal end region defining an aperture to provide access to the interior. A lid has a second side wall extending from an end wall along the longitudinal axis, with the distal end region of the container is received by the lid to enclose the interior. A magnetic member is supported by one of the lid and the container via a biasing member for movement in a transverse direction between a first position and a second position. The other of the lid and the container defines a flange extending in the transverse direction. When the lid is assembled to the container, the flange is positioned between the aperture and the magnetic member with the magnetic member in the first position to lock the container. With the magnetic member in the second position, the magnetic member is transversely spaced apart from the flange such that the lid is moveable along the longitudinal axis to open the container.

DETAILED DESCRIPTION

Figure 1:
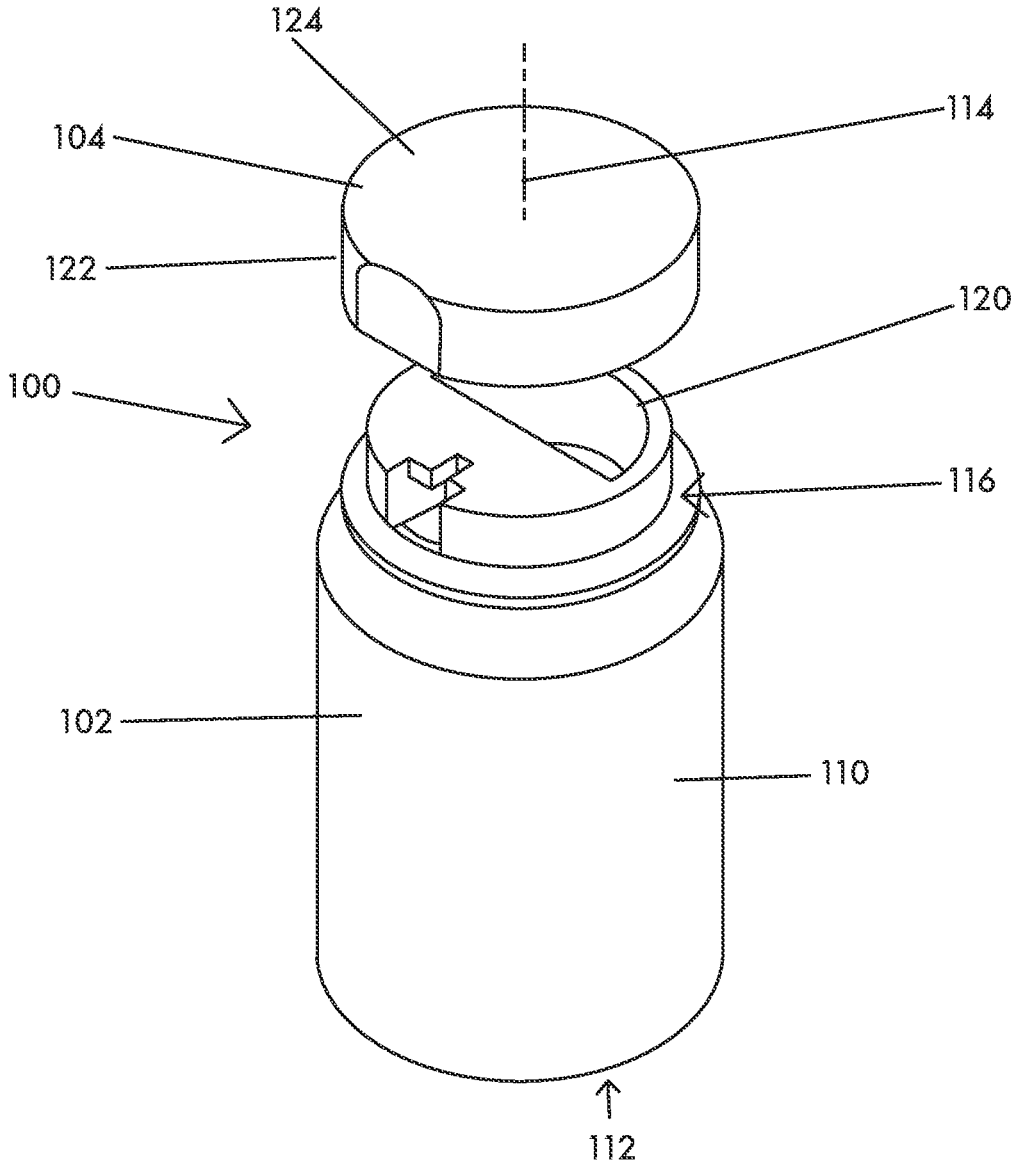
FIG. 1 illustrates a perspective view of a container assembly according to an embodiment.
Figure 2:
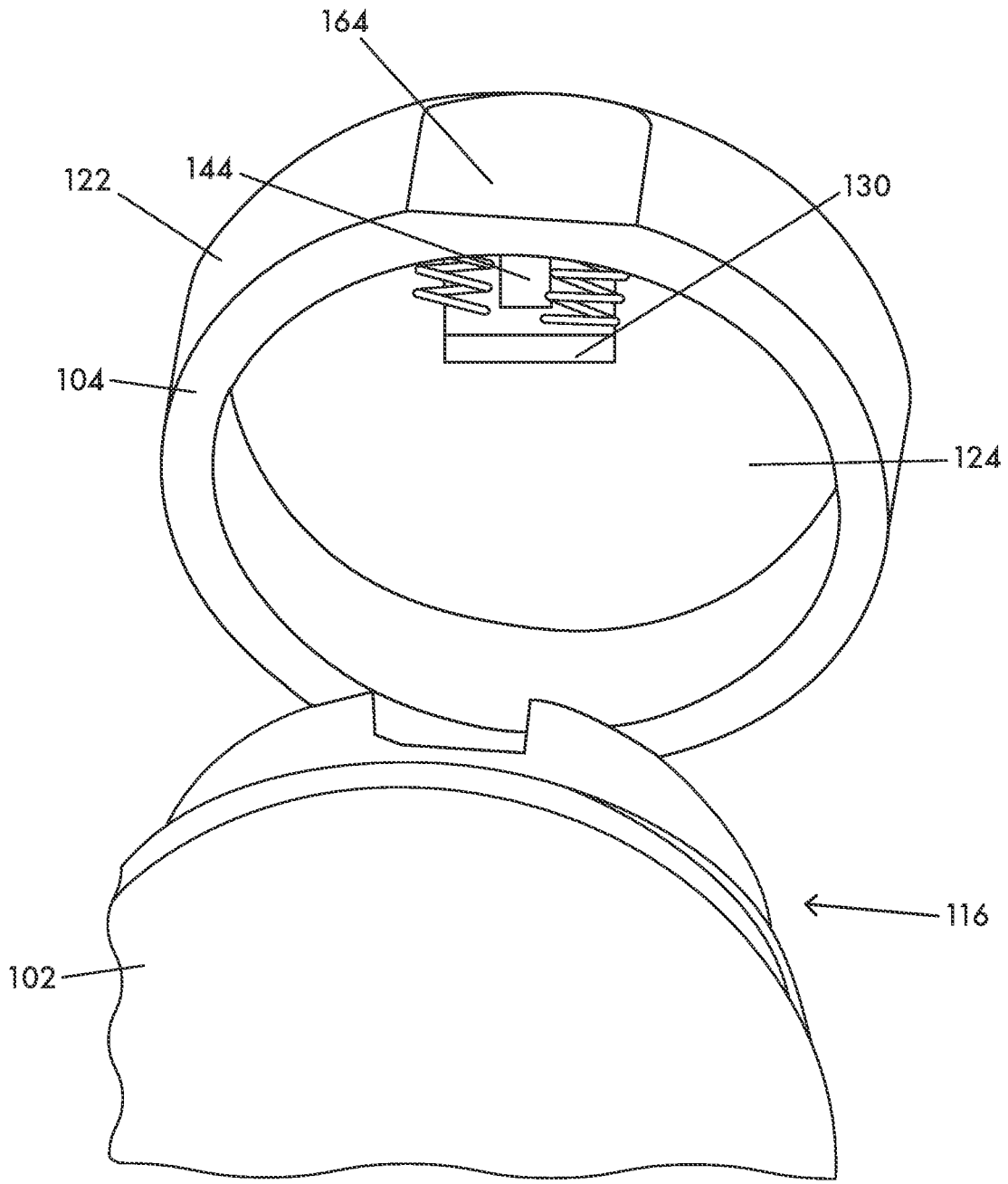
FIG. 2 illustrates a partial perspective view of the container assembly of FIG. 1.
Figure 3:
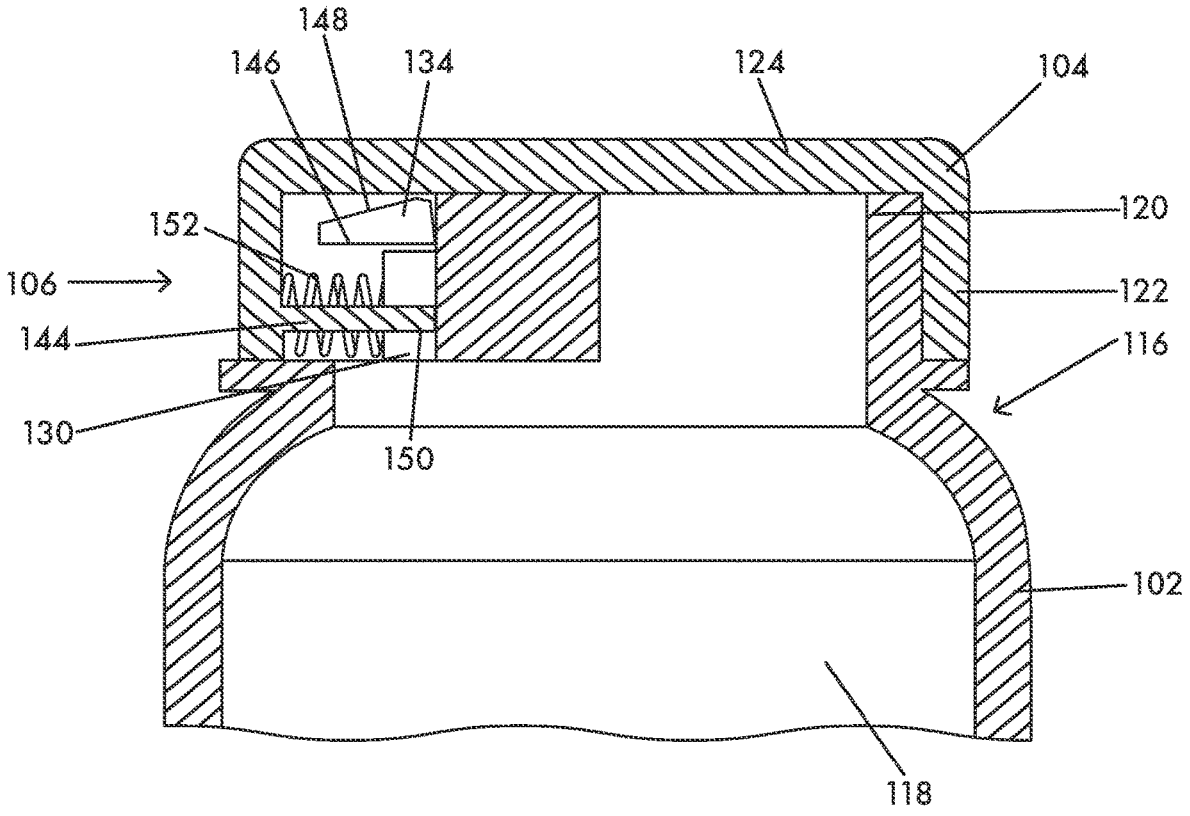
FIG. 3 illustrates a partial sectional view of the container assembly of FIG. 1.
Figure 4:
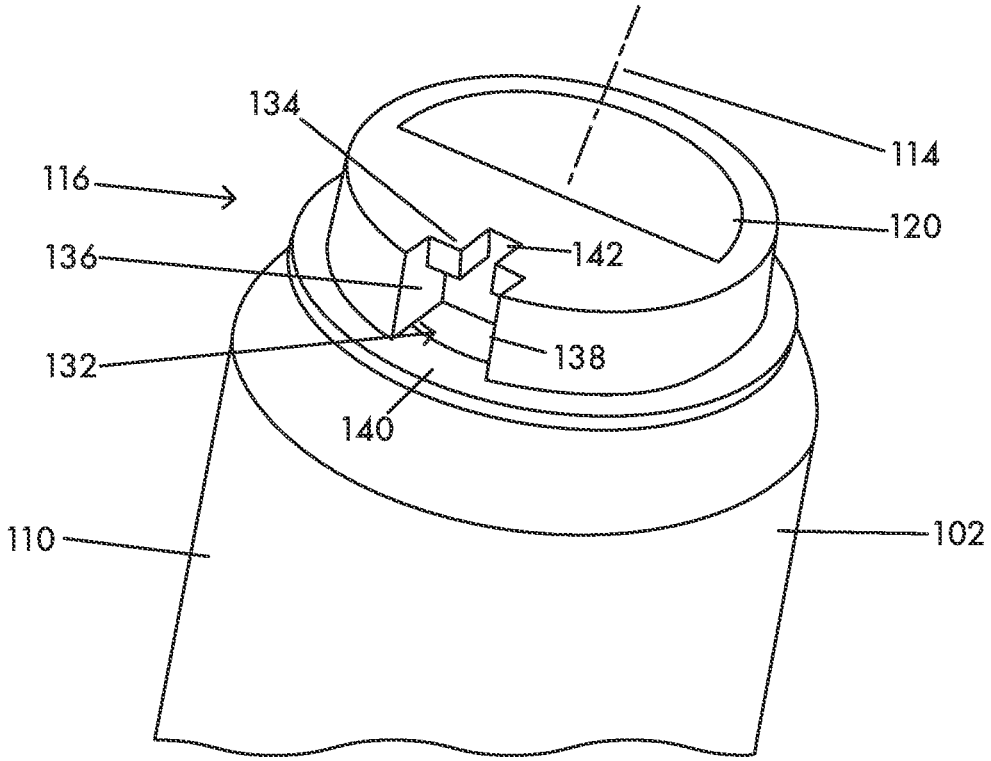
FIG. 4 illustrates a partial perspective view of a container of the container assembly of FIG. 1.
Figure 5:
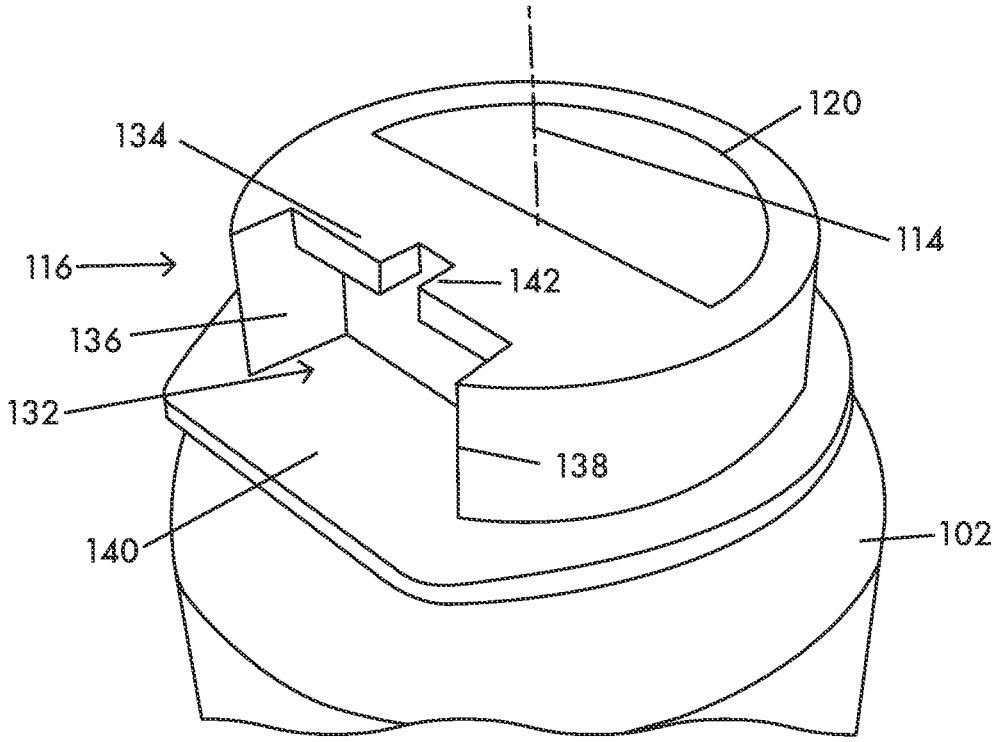
FIG. 5 illustrates a partial perspective view of a container of the container assembly of FIG. 1 according to another embodiment.
Figure 6:
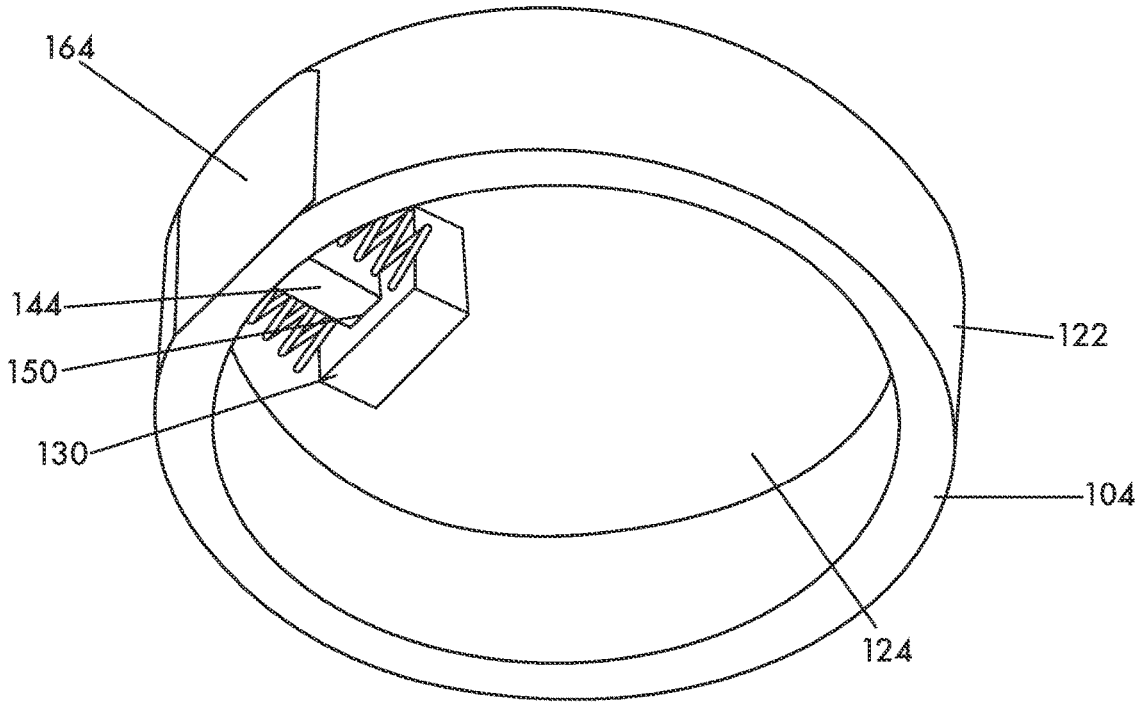
FIG. 6 illustrates a perspective view of a lid of the container assembly of FIG. 1.
Figure 7:
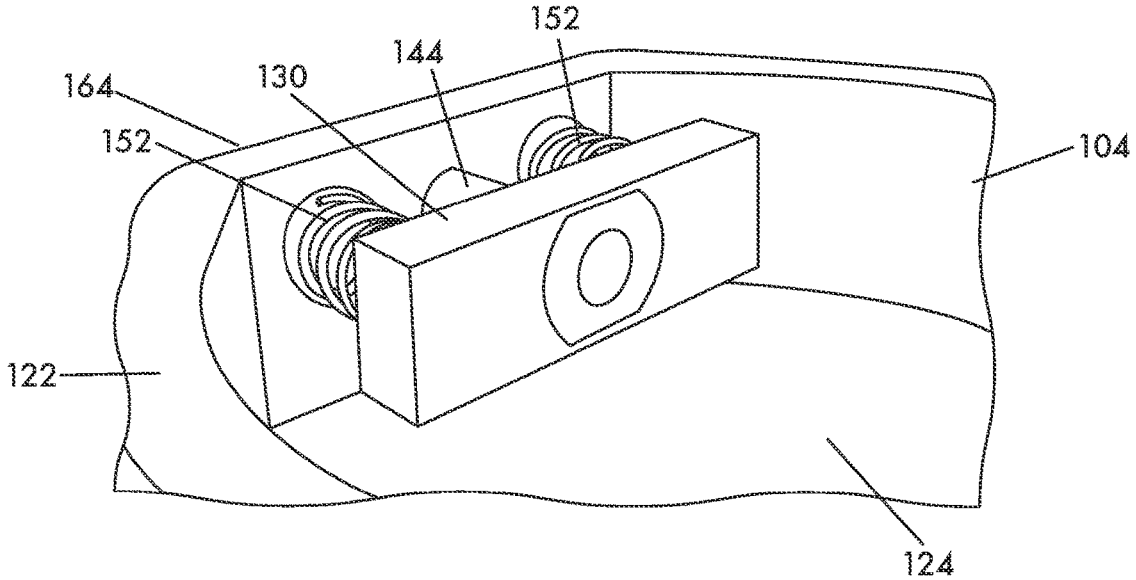
FIG. 7 illustrates a partial perspective view of the lid of the container assembly of FIG. 1.
Figure 8:
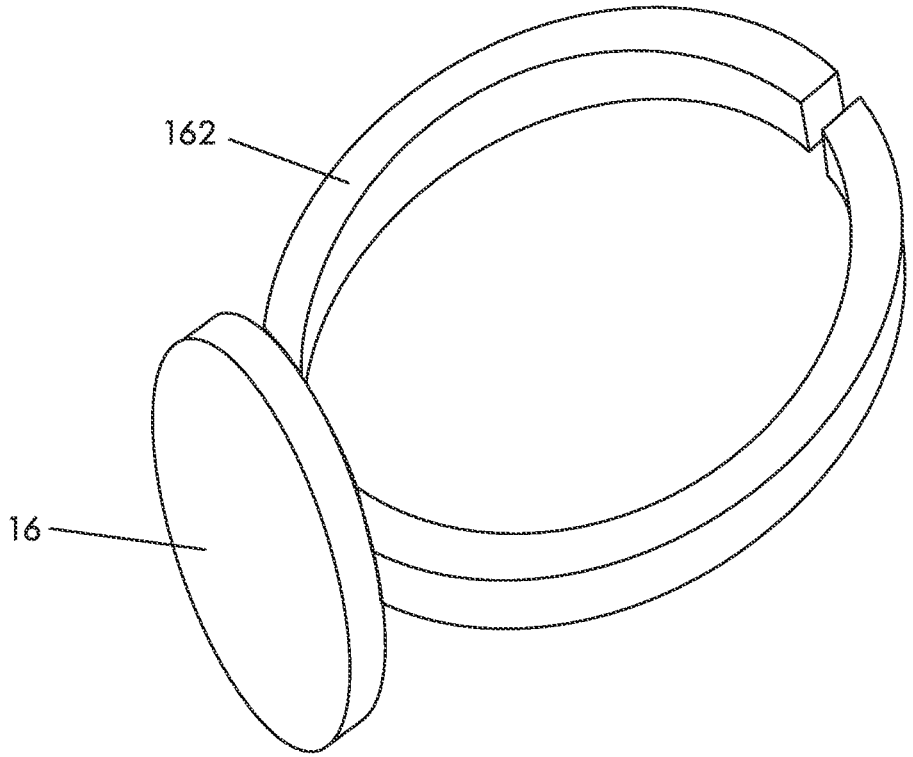
FIG. 8 illustrates a perspective view of a ring for use with the container assembly of FIG. 1.

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

FIGS. 1-8 illustrate a container assembly 100 includes both a container 102 and a lid 104 or cap. The lid 104 is retained onto the container 102 via a locking mechanism 106. The container assembly 100 provides a child safety lock that is also easy for an adult, including adults with reduced strength or dexterity, to unlock and open. The container assembly 100 may be provided as a medicine bottle containing a prescription medicine such as a pill, capsule, or liquid. Alternatively, the container assembly 100 may be provided as another lockable type of container or child-resistant packaging, such as for cleaning supplies, other hazardous materials, or the like.

The container 102 or bottle has a first side wall 110 extending from a base 112 along a longitudinal axis 114 to a distal end region 116. The first side wall 110 may be continuous and surrounds an interior 118 of the container 102. The distal end region 116 defines an aperture 120 to provide access to the interior 118. The container 102 is shown as having a cylindrical side wall 110, although other shaped side walls are also contemplated.

The lid 104 or cap has a second side wall 122 extending from an end wall 124. The second side wall may be continuous as shown. The first side wall 110 of the container 102 is sized to be received by the second side wall of the lid 104 to enclose the interior 118 of the container. As shown, the lid 104 and the container 102 are without a threaded connection such that the lid 104 slides with respect to, and in one embodiment onto, the distal end region 116 of the container 102 along the longitudinal axis 114.

Each of the lid 104 and the container 102 may be formed from a plastic material, and may be injected molded. In one example, the lid 104 and container 102 may be formed from a thermoplastic polymer such as polypropylene.

The container assembly 100 has a locking mechanism 106 that locks the lid 104 relative to the container 102. The locking mechanism 106 may be provided as a safety device or child-resistant lock for the container assembly 100, for example, to inhibit children from opening the container assembly 100 and accessing the contents.

The locking mechanism 106 has a first magnetic member 130 that cooperates with a recess 132 or flange 134 to inhibit removal of the lid 104 from the container 102. The recess 132 may also be described as a keyhole structure in the distal end region or rim region of the container 102 or bottle. The recess 132 is sized to receive the first magnetic member 130 therein with the first magnetic member 130 in the first position.

The distal end region 116 of the container 102 may define the recess 132. The distal end region 116 forms a flange 134 that extends transversely to the first side wall 110 to define a portion of the recess 132 or keyhole. The distal end region 116 forms first and second side faces 136, 138, with the flange 134 positioned between the first and second side faces 136, 138. The distal end region 116 forms a transverse face 140, with the transverse face 140 positioned between the flange 134 and the base 112 of the container 102. The first and second side faces 136, 138 are positioned between, and in one example, extend between, the transverse face 140 and the flange 134.

The flange 134 may define a slot 142 extending transversely. The slot 142 has a width that is greater than a width of a post 144 on the lid 104 as described below such that the post 144 passes through or extends through the slot 142 when the lid 104 is being assembled to the container 102 or removed from the container 102. A width of the first magnetic member 130 is greater than a width of the slot 142.

The first and second side faces 136, 138, the transverse face 140, and the flange 134 cooperate to define a perimeter of the recess 132. In the example shown, each of the first and second side faces 136, 138, the transverse face 140, and the flange 134 extend inwardly from an outer surface of the first side wall 110 towards the interior.

The first magnetic member 130 is adjacent to or abuts a transverse surface 146 of the flange 134 in the first position to limit movement of the lid 104 along the longitudinal axis 114 and retain the lid 104 on the container 102.

The first magnetic member 130 is adjacent to or abuts the first side face 136 in the first position to limit clockwise rotation of the lid 104 about the longitudinal axis 114 and retain the lid 104 on the container 102. Likewise, the first magnetic member 130 is adjacent to or abuts the second side face 138 in the first position to limit counterclockwise rotation of the lid 104 about the longitudinal axis 114 and retain the lid 104 on the container 102.

The transverse face 140 may extend about an outer perimeter of the first side wall 110 such that the lid 104 is adjacent to or abuts the transverse face 140 to limit movement of the lid 104 relative to the container 102 along the longitudinal axis 114 when closing the container 102.

In further examples, the flange 134 defines a ramp surface 148 opposite to the transverse surface 146. The ramp surface 148 is angled relative to the transverse surface 146, e.g. at an acute angle relative thereto, to impart a force in the transverse direction on the first magnetic member 130 to move the first magnetic member 130 from the first position towards the second position when the lid 104 is being assembled to the container 102 such that the magnetic member passes by the flange 134 and moves into the recess 132 without the need to use the second magnetic member as described below. The first magnetic member 130 may be provided with a corresponding ramp on a lower surface of the magnetic member 130 to cooperate with the ramp surface 148.

As shown in FIGS. 1-8, the first magnetic member 130 is supported by the lid 104 for transverse movement between a first position and a second position. In the example shown, with a cylindrical side wall 110, the first magnetic member 130 may move in a radial direction. The first magnetic member 130 may slide or translate between the first and second positions, and in a further example, may slide or translate along either a linear path or an arcuate path within a plane that is transverse or substantially transverse to the longitudinal axis 114. The first magnetic member 130 may be supported for transverse movement between the first and second positions within a plane perpendicular or substantially perpendicular to the longitudinal axis 114. As used herein, substantially means within five degrees, within ten degrees, or within twenty degrees of the stated orientation.

When the lid 104 is assembled onto the container 102, the first magnetic member 130 is received by the recess 132 (or cooperates with the flange 134) in the first position to limit movement of the lid 104 along the longitudinal axis 114 and lock the container 102. When the first magnetic member 130 is moved into the second position, the first magnetic member 130 is spaced apart from the recess 132 (or spaced apart from the flange 134) such that the lid 104 is moveable along the longitudinal axis 114 to open the container 102.

The lid 104 has a post 144 extending transversely. In the example shown, the post 144 extends inwardly from the second side wall 122 of the lid 104. The first magnetic member 130 is supported by the post 144 and translates along the post between the first and second positions. The post 144 may extend inwardly from the second side wall 122 of the lid 104. The first magnetic member 130 is adjacent to an inboard end of the post 144 in the first position, and is adjacent to the side wall of the lid 104 in the second position.

The first magnetic member 130 defines an aperture 150 therethrough, and the first magnetic member 130 may be arranged on the post 144 such that the post 144 extends through the aperture 150. In one example, and as shown, the post 144 and aperture 150 have corresponding non-circular shapes such that the first magnetic member 130 cannot rotate about the post 144. The post 144 may be rectangular, or have another shape such as hexagonal or the like.

Figure 9A:
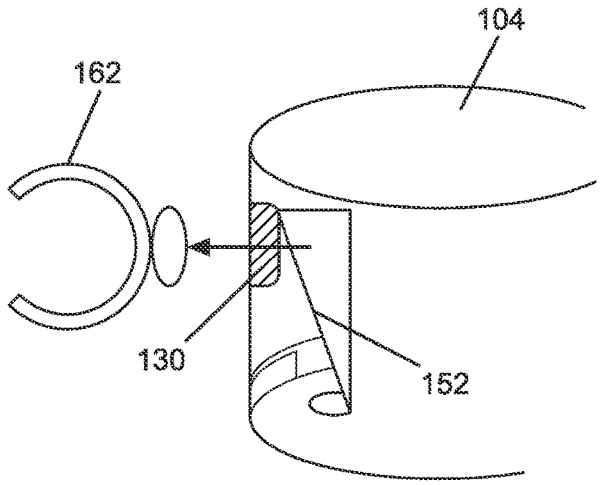
FIGS. 9A, 9B, and 9C illustrates various views of a locking mechanism for use with the container assembly according to another embodiment.
Figure 9B:
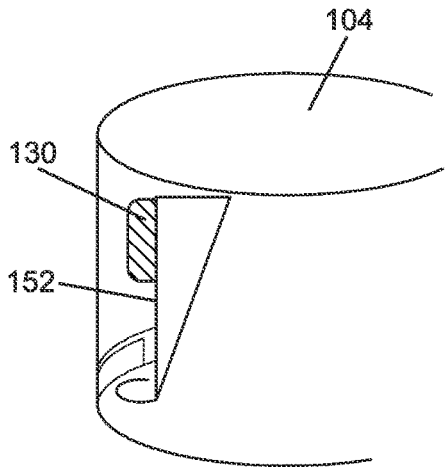
Figure 9C:
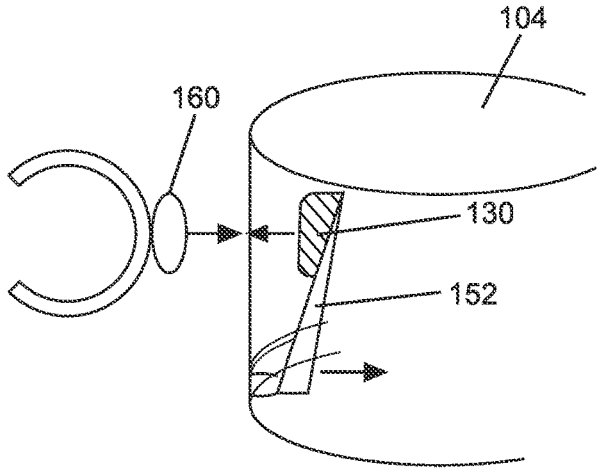

The locking mechanism 106 is provided with at least one biasing member 152. The biasing member 152 biases the first magnetic member 130 towards the first position. The biasing member 152 may bias the first magnetic member 130 inwardly towards the longitudinal axis 114 as shown. In the example shown, the locking mechanism 106 has first and second biasing members 152 that are each provided by a coil spring, with the post 144 positioned between the first and second biasing members 152. In other examples, the locking mechanism 106 may have a single biasing member 152, which may be a coil spring arranged with the post 144 extending through a center of the spring. In other examples, the first magnetic member 130 may only be supported on the lid 104 by the biasing member 152, e.g. a leaf spring or the like as shown in FIGS. 9A, 9B, and 9C, with the container assembly 100 being provided without a supporting post.

In one example, and as shown, the biasing members 152 connect the first magnetic member 130 to the side wall of the lid 104 and biases the first magnetic member 130 towards the first position. The first and second biasing members 152 may be in a natural state or resting state such that they are not tensioned or compressed when the first magnetic member 130 is in the first position.

A first end of each of the biasing members 152 is connected to the first magnetic member 130, and a second end of each of the biasing members 152 is connected to the lid 104. The biasing members 152 may be connected using an adhesive material, and/or may be otherwise chemically or mechanically fastened to the respective components.

The container assembly 100 also has a second magnetic member 160. The second magnetic member 160 is used to move the first magnetic member 130 from the first position to the second position when the second magnetic member 160 is positioned adjacent to the container 102, or adjacent to the second side wall 122 of the lid 104. The second magnetic member 160 exerts a magnetic force on the first magnetic member 130 that overcomes the opposing spring force exerted on the first magnetic member 130 by the biasing member 152 in order to move the first magnetic member 130 from the first position to the second position.

The first magnetic member 130 and/or the second magnetic member 160 may be formed from a permanent magnet. In another example, one of the first and second magnetic members 130, 160 may be formed from a material with magnetic properties, such as a ferrous material. In one example, the first magnetic member 130 is formed from a ferrite magnet, and the second magnetic member 160 is formed from a neodymium magnet.

For the example as shown in FIGS. 1-8, the second magnetic member 160 is positioned to attract the first magnetic member 130 to move the first magnetic member 130 from the first position to the second position. The second magnetic member 160 may be provided on a ring 162 that is sized to receive a finger of a user. In a further example, the ring 162 is sized to receive a thumb of a user. The ring 162 may be adjustable to accommodate different finger sizes. Alternatively, the ring 162 may be offered in a selection of standardized ring sizes. In further examples, the ring 162 may be provided with a decorative finish with the appearance of jewelry, and may be made from a plastic material or from various metals. In other examples, the second magnetic member 160 may be provided on a fob, or the like.

The lid 104 may be provided with an indicia 164 that indicates a location for a user to position the second magnetic member 160 to move the first magnetic member 130 and unlock the lid 104. The container 102 may additionally be provided with another indicia for the user to align the lid 104 with the container 102 when placing the lid 104 onto the container 102. In one example, the indicia 164 is provided by a chamfer or other shape on an outer surface of the second side wall 122 of the lid 104. In another example, the indicia 164 may be provided by an embossed writing or symbol, different color, or other indicator.

To open the container assembly 100, the user lines up their finger or thumb with the ring 162 on it with the chamfer or flat side of the lid 104, which is a natural motion. The second magnetic member 160 of the ring 162 attracts the first magnetic member 130 in the lid 104, and as the two magnetic members 130, 160 are attracted to one another, the biasing members 152 or springs are compressed to bring the first magnetic member 130 towards the second magnetic member 160 thus positioning the first magnetic member 130 outboard of the flange 134 and into the open section of the recess or keyhole in the container 102. Now, the container 102 is unlocked and can be easily opened by exerting a flipping up motion onto the lid 104.

Figure 10:
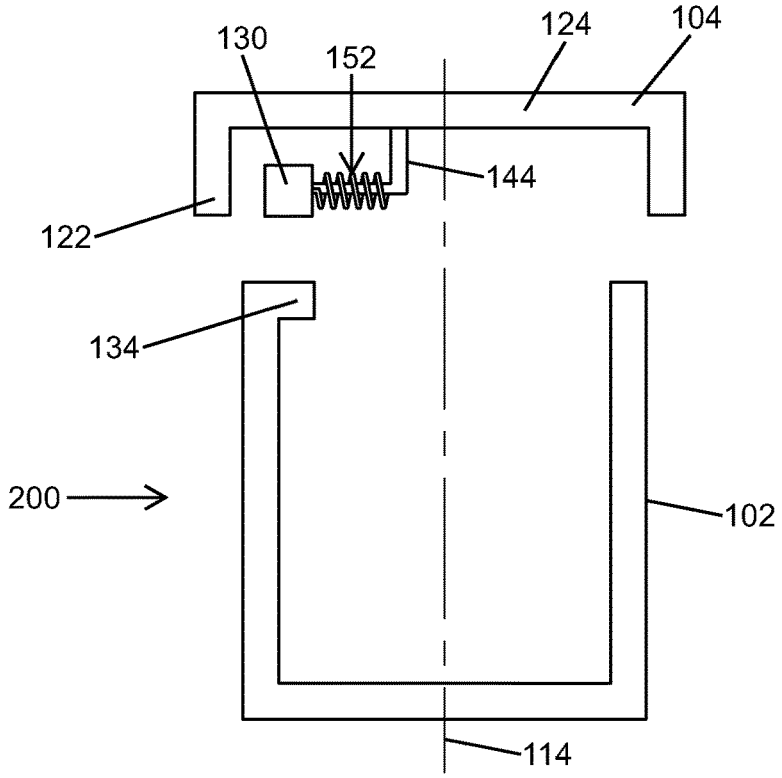
FIG. 10 illustrates a side schematic view of a container assembly according to another embodiment.

FIG. 10 illustrates a container assembly 200 according to another example. Elements that are the same as or similar to those described above with respect to FIGS. 1-8 are given the same reference numbers. The container assembly 200 has a first magnetic member 130 supported by the end wall 124 of the lid 104 in a central region of the end wall 124 for movement in a transverse direction, with a biasing member 152 biasing the first magnetic member 130 outwardly towards the second side wall 122 of the lid 104. The distal end 116 of the container 102 defines a flange 134 that extends in a transverse direction inwardly towards the longitudinal axis 114. The first magnetic member 130 is adjacent to or engaged with the flange 134 in the first position. The second magnetic member 160 interacts with the first magnetic member 130 to move the first magnetic member 130, e.g. by repelling it, inwardly from the first position towards the second position such that the first magnetic member 130 is spaced apart from the flange 134 and the lid 104 may be removed from the container 102.

Figure 11:
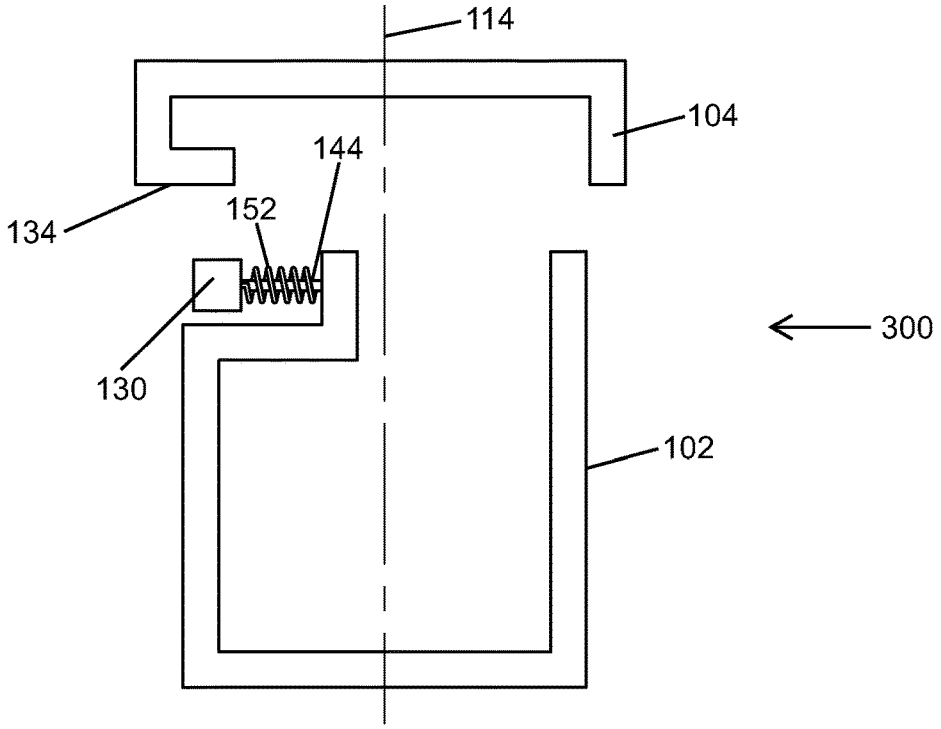
FIG. 11 illustrates a side schematic view of a container assembly according to yet another embodiment.

FIG. 11 illustrates a container assembly 300 according to another example. Elements that are the same as or similar to those described above with respect to FIGS. 1-8 are given the same reference numbers. The container assembly 300 has a first magnetic member 130 supported by the container 102 for movement in a transverse direction, and extend outwardly from an outer surface of the distal end region 116. A biasing member 152 biases the first magnetic member 130 outwardly towards the first position. The second side wall 122 of the lid 104 may define a flange 134 that extends in a transverse direction inwardly towards the longitudinal axis. The first magnetic member 130 is adjacent to or engaged with the flange 134 in the first position. The second magnetic member 160 interacts with the first magnetic member 130 to move the first magnetic member 130, e.g. by repelling it, inwardly from the first position towards the second position such that the first magnetic member 130 is spaced apart from the flange 134 and the lid 104 may be removed from the container 102.

Figure 12:
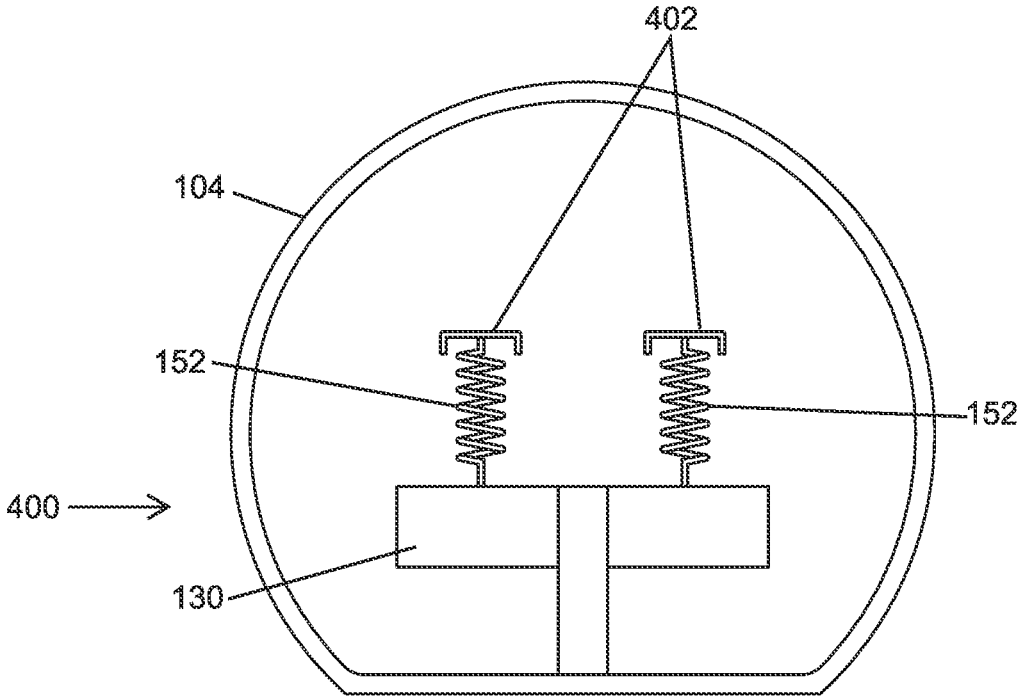
FIG. 12 illustrates a bottom schematic view of a lid of a container assembly according to another embodiment.
Figure 13:
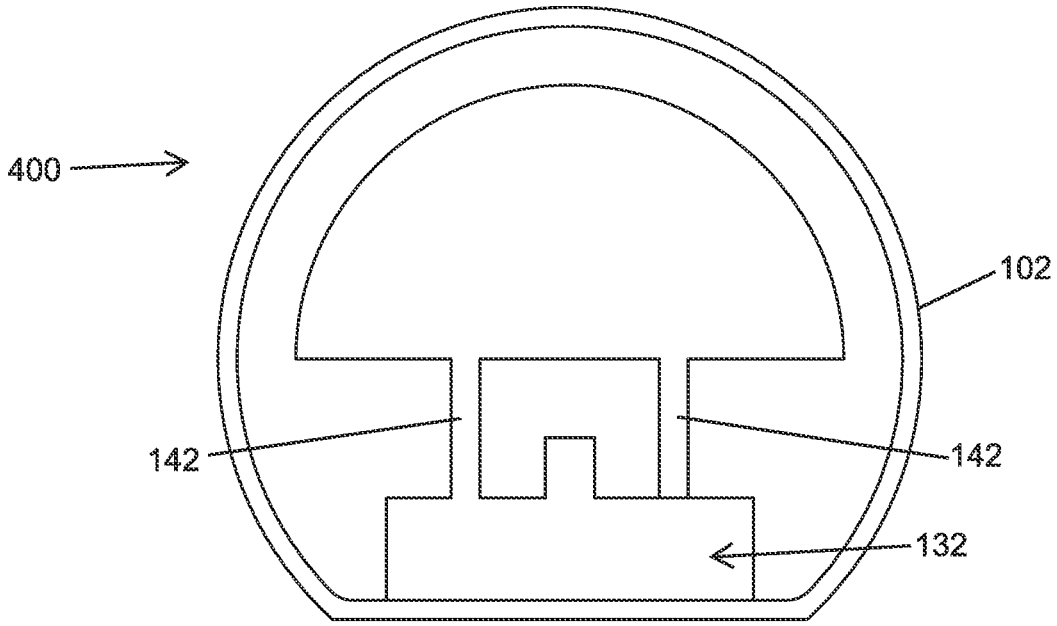
FIG. 13 illustrates a top schematic view of a container of the container assembly of FIG. 12.

FIGS. 12 and 13 illustrate a container assembly 400 according to another example. Elements that are the same as or similar to those described above with respect to FIGS. 1-8 are given the same reference numbers. The container assembly 400 has a first magnetic member 130 supported by the lid 104 for movement in a transverse direction, and may be supported by a post or other similar support element as shown in FIG. 12. At least one biasing member 152 biases the first magnetic member 130 inwardly as shown towards the first position. One end of each biasing member is connected to the magnetic member 130, and the other end is connected to the lid 104, e.g. in a central region of the lid. An attachment feature 402 such as a hook may be provided on the lid, and the end of the biasing member 152 may connect to the lid via an associated attachment feature 402.

The container 102 of the container assembly 400 is shown in FIG. 13, and the distal end region of the container 102 defines a recess 132 and a flange that extends in a transverse direction inwardly towards the longitudinal axis. The first magnetic member 130 is received within the recess 132 in the first position. The second magnetic member interacts with the first magnetic member 130 to move the first magnetic member 130, e.g. by attracting it, outwardly from the first position towards the second position such that the first magnetic member 130 is spaced apart from the recess 132 and flange, and the lid 104 may be removed from the container 102. The biasing members 152 are tensioned or extended when the first magnetic member 130 is moved from the first position to the second position by the second magnetic member. The biasing members 152 therefore pull the first magnetic member 130 back towards the first position as shown in FIG. 12.

For the various embodiments described above, when the lid 104 is assembled to the container 102, the flange 134 is positioned between aperture 120 and the magnetic member with the magnetic member in the first position to limit movement of the lid 104 along the longitudinal axis 114 and lock the container 102.

To unlock the locking mechanism and open the container 102, a user places the second magnetic member 160 adjacent to the lid 104 to move the first magnetic member 130 to the second position and unlock the locking mechanism. With the magnetic member in the second position, the magnetic member is transversely spaced apart from the flange 134 such that the lid 104 is moveable along the longitudinal axis 114 to open the container 102. The user may then slide the lid 104 along the longitudinal axis 114 and off of the container 102 and access the contents in the interior.

To replace the lid 104 onto the container 102, the user positions the corresponding indicia on the lid 104 and the container 102 and translates the lid 104 towards the container 102 along the longitudinal axis. The user may need to position the second magnetic member 160 adjacent to the lid 104 to move the first magnetic member 130 to the second position and allow the first magnetic member 130 to slide over the flange 134. In other examples, a ramp or other surface may be provided to move the first magnetic member 130 towards the second position and allow the first magnetic member 130 to slide over the flange 134 when replacing the lid 104 on the container 102.

While exemplary embodiments are described above, it is not intended that these embodiments describe all possible forms of the invention and disclosure. Rather, the words used in the specification are words of description rather than limitation, and it is understood that various changes may be made without departing from the spirit and scope of the invention. Additionally, the features of various implementing embodiments may be combined to form further embodiments of the invention and disclosure.

What is claimed is:

1. A container assembly comprising:

a container having a first side wall extending outwardly from a base along a longitudinal axis to a distal end region, the first side wall defining an interior of the container, the distal end region defining an aperture to provide access to the interior, the distal end region defining a recess;

a lid having a second side wall extending outwardly from an end wall; and a magnetic member supported by the lid for transverse movement between a first position and a second position;

wherein the first side wall of the container is sized to be received by the second side wall of the lid to enclose the interior of the container;

wherein, when the lid is cooperatively associated with the container, the magnetic member is received by the recess in the first position to inhibit movement of the lid along the longitudinal axis and lock the container;

wherein, with the magnetic member in the second position, the magnetic member is spaced apart from the recess such that the lid is moveable along the longitudinal axis to open the container; and wherein the lid further comprises a biasing member connecting the magnetic member to the lid, the biasing member biasing the magnetic member towards the first position.

2. A container assembly comprising:

a container having a first side wall extending outwardly from a base along a longitudinal axis to a distal end region, the first side wall defining an interior of the container, the distal end region defining an aperture to provide access to the interior, the distal end region defining a recess;

a lid having a second side wall extending outwardly from an end wall; and a magnetic member supported by the lid for transverse movement between a first position and a second position;

wherein the first side wall of the container is sized to be received by the second side wall of the lid to enclose the interior of the container;

wherein, when the lid is cooperatively associated with the container, the magnetic member is received by the recess in the first position to inhibit movement of the lid along the longitudinal axis and lock the container;

wherein, with the magnetic member in the second position, the magnetic member is spaced apart from the recess such that the lid is moveable along the longitudinal axis to open the container;

wherein the lid further comprises a post extending transversely, the magnetic member supported for translation between the first and second positions by the postpost; and wherein the magnetic member defines an aperture therethough, the post extending through the aperture.

3. The container assembly of claim 2 wherein the post extends inwardly from the second side wall of the lid; and wherein the container assembly further comprises a biasing member having a first end connected to the magnetic member and a second end connected to the lid, the biasing member biasing the magnetic member towards the first position.

4. The container assembly of claim 3 wherein the biasing member is a first biasing member;

wherein the container assembly further comprises a second biasing member having a first end connected to the magnetic member and a second end connected to the lid, the second biasing member biasing the magnetic member towards the first position; and wherein the post is positioned between the first and second biasing members.

5. The container assembly of claim 1 wherein the biasing member biases the magnetic member inwardly towards the longitudinal axis.

6. A container assembly comprising:

a container having a first side wall extending outwardly from a base along a longitudinal axis to a distal end region, the first side wall defining an interior of the container, the distal end region defining an aperture to provide access to the interior, the distal end region defining a recess;

a lid having a second side wall extending outwardly from an end wall; and a magnetic member supported by the lid for transverse movement between a first position and a second position;

wherein the first side wall of the container is sized to be received by the second side wall of the lid to enclose the interior of the container;

wherein, when the lid is cooperatively associated with the container, the magnetic member is received by the recess in the first position to inhibit movement of the lid along the longitudinal axis and lock the container; and wherein, with the magnetic member in the second position, the magnetic member is spaced apart from the recess such that the lid is moveable along the longitudinal axis to open the container;

wherein the magnetic member is a first magnetic member; and wherein the container assembly further comprises a second magnetic member, wherein the second magnetic member moves the first magnetic member from the first position to the second position when the second magnetic member is positioned adjacent to the second side wall of the lid.

7. The container assembly of claim 6 wherein the lid defines an indicia indicative of a location to position the second magnetic member to move the first magnetic member.

8. The container assembly of claim 7 wherein the indicia is provided by a chamfer on an outer surface of the second side wall of the lid.

9. The container assembly of claim 6 further comprising a ring sized to receive a finger of a user, the ring supporting the second magnetic member.

10. The container assembly of claim 1 wherein the distal end region forms a flange extending transversely to the first side wall to define a portion of the recess; and wherein the magnetic member abuts a transverse surface of the flange in the first position to limit movement of the lid along the longitudinal axis and retain the lid on the container.

11. The container assembly of claim 10 wherein the distal end region forms first and second side faces, the flange positioned between the first and second side faces;

wherein the magnetic member abuts the first side face in the first position to limit clockwise rotation of the lid about the longitudinal axis and retain the lid on the container; and wherein the magnetic member abuts the second side face in the first position to limit counterclockwise rotation of the lid about the longitudinal axis and retain the lid on the container.

12. The container assembly of claim 10 wherein the flange defines a ramp surface opposite to the transverse surface, the ramp surface to move the magnetic member from the first position towards the second position when the lid is being assembled to the container such that the magnetic member passes by the flange and moves into the recess.

13. The container assembly of claim 10 wherein the lid further comprises a post extending transversely, the magnetic member supported for translation by the post;

wherein the flange defines a slot extending transversely, the post sized to extend through the slot when the lid is being assembled to the container; and wherein a width of the magnetic member is greater than a width of the slot.

14. The container assembly of claim 1 wherein the magnetic member is a first magnetic member; and wherein the container assembly further comprises a second magnetic member, wherein the second magnetic member moves the first magnetic member from the first position to the second position when the second magnetic member is positioned adjacent to the second side wall of the lid.

15. The container assembly of claim 2 wherein the magnetic member is a first magnetic member; and wherein the container assembly further comprises a second magnetic member, wherein the second magnetic member moves the first magnetic member from the first position to the second position when the second magnetic member is positioned adjacent to the second side wall of the lid.

16. The container assembly of claim 6 wherein the lid further comprises a biasing member connecting the magnetic member to the lid, the biasing member biasing the magnetic member towards the first position.

* * * * *